United States Patent [19]

Thibodeau

[11] 4,417,657

[45] Nov. 29, 1983

[54] BEVERAGE CAN CONTAINER

[76] Inventor: David T. Thibodeau, 126 Stephens Rd., Grosse Pointe Farms, Mich. 48236

[21] Appl. No.: 325,300

[22] Filed: Nov. 27, 1981

[51] Int. Cl.[3] ..... B65D 71/00

[52] U.S. Cl. ..... 206/427; 206/200; 206/203; 220/22; 229/52 A

[58] Field of Search ..... 206/140, 147, 148, 152, 206/154, 156, 157, 160, 175, 178, 193, 195, 196, 200, 427, 428, 429, 430, 431, 434, 435, 203; 229/28 BC, 52 A, 52 AC, 52 AL, 52 AM, 52 AW, 52 BC; 220/19, 23, 22

[56] References Cited

U.S. PATENT DOCUMENTS

| | | | |
|---|---|---|---|
| 2,180,841 | 11/1939 | Vogt | 220/463 |
| 2,330,671 | 9/1943 | Boh et al. | 217/23 |
| 2,359,297 | 10/1944 | Brogden | 229/52 BC |
| 2,591,593 | 4/1952 | Nolan | 229/52 BC |
| 2,654,475 | 10/1973 | Carpenter | 206/428 |
| 3,281,010 | 10/1966 | Moore et al. | 206/203 |
| 3,540,581 | 11/1970 | Koolnis | 206/193 |
| 3,587,699 | 6/1971 | Kovach | 229/52 AL |
| 4,290,525 | 9/1981 | Sisson | 206/427 |
| 4,300,697 | 11/1981 | Dickens | 220/19 |

FOREIGN PATENT DOCUMENTS

| | | | |
|---|---|---|---|
| 440718 | 1/1936 | United Kingdom | 229/52 BC |

*Primary Examiner*—George E. Lowrance
*Assistant Examiner*—Jimmy G. Foster
*Attorney, Agent, or Firm*—Barnes, Kisselle, Raisch, Choate, Whittemore & Hulbert

[57] ABSTRACT

An open top container for beverage cans and the like divided into chambers adapted to hold the cans in vertical stacks. The container may be of any suitable material. It may be formed from a single sheet or panel folded into the shape of a container. A releasable strap across the top of the container serves to retain the cans and also as a means of transporting the container by hand.

1 Claim, 8 Drawing Figures

BEVERAGE CAN CONTAINER

SUMMARY OF THE INVENTION

The container of this invention is capable of general use, but is intended primarily as a handy means of storing and carrying empty beverage cans. The container is designed for convenience. It may be made of any suitable material such as plastic or cardboard. It provides a protective package for empty cans which will slide easily in and out, even if crushed. The container may be used to collect and store empties until the container is full and ready for return to the market for refund.

The container of this invention is also designed to save space. It will rest on any one of its sides and may be kept in multiples of two or more containers for storing large quantities of cans.

The container is of simple lightweight construction and substantially trouble free. A carrying strap may be provided which when in place will prevent the cans from falling out.

The container may be of any size, but preferably is designed to hold twenty-four (24) cans, or one full case. The contents of the container are readily visible to an observer, making it easy to calculate the amount of the refund due at the beverage store. After the empty cans are returned, the container may be loaded with full cans.

The container of this invention is sanitary and easily washed or rinsed. The cans are exposed to the open air and, therefore, will be less likely to develop an unpleasant odor or grow mold or mildew. Any beverage residue inside the cans can be emptied even after the cans are in the container. Also the cans may be sprayed or washed even when inside the container.

These and other objects and features of the invention will become more apparent as the following description proceeds especially when considered with the accompanying drawings.

DETAILED DESCRIPTION

Figure 1:
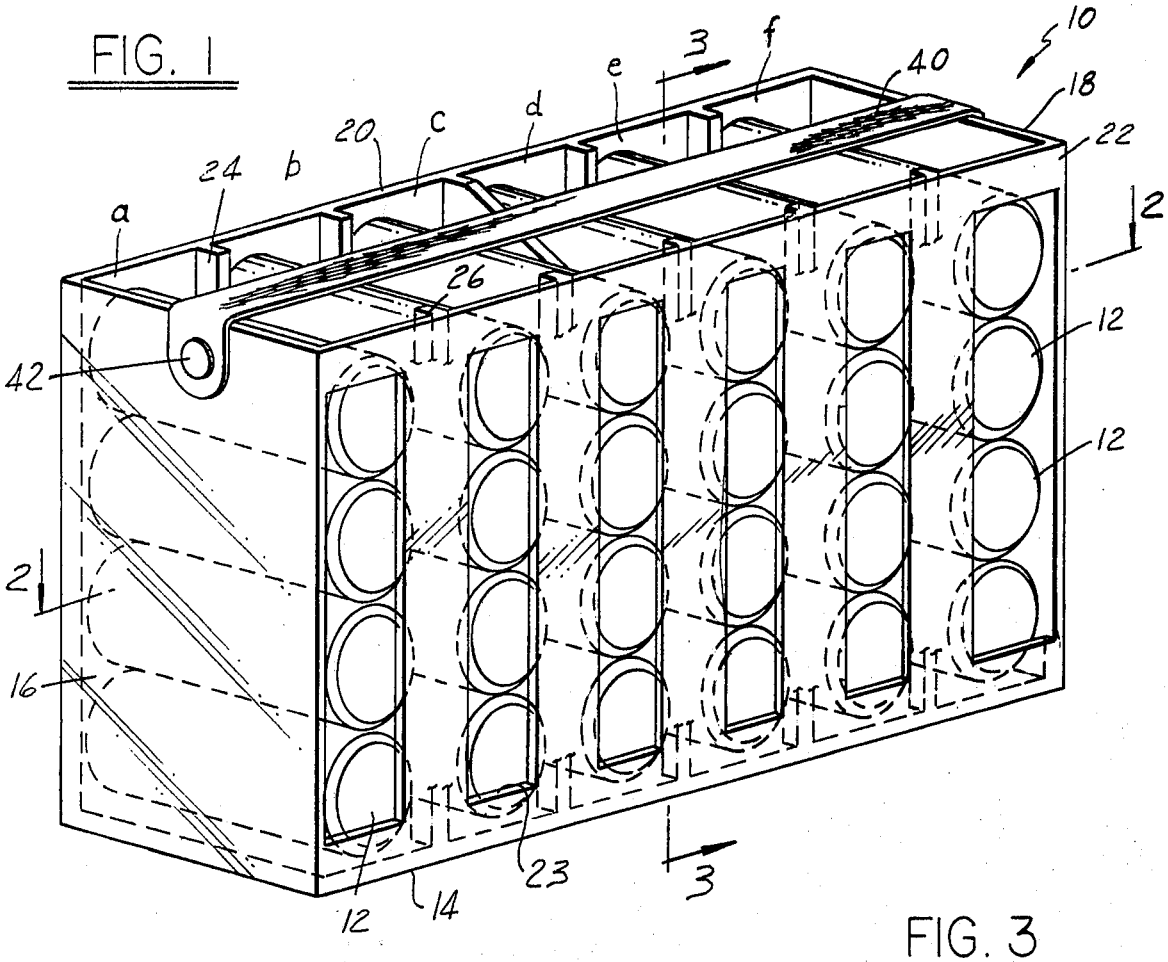
FIG. 1 is a perspective view of a beverage can container constructed in accordance with this invention.
Figure 2:
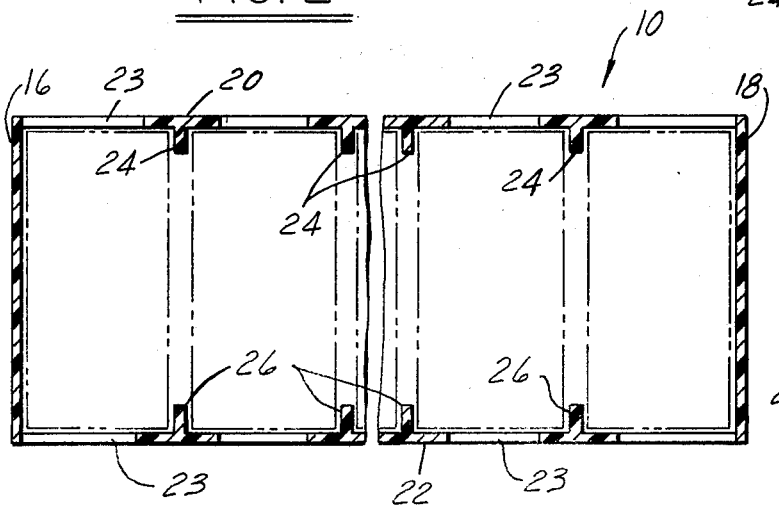
FIG. 2 is a sectional view taken on the line 2—2 in FIG. 1.
Figure 3:
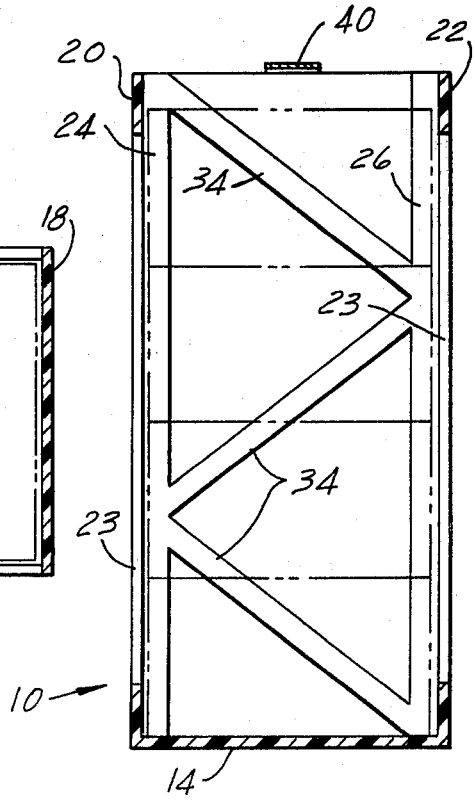
FIG. 3 is a sectional view taken on the line 3—3 in FIG. 1.

Referring now more particularly to the drawings and especially to FIGS. 1-3, the numeral 10 generally designates an open top container and the numeral 12 a plurality of beverage cans within the container. The beverage cans are of the same length and diameter. They may, for example, be standard, cylindrical 12 ounce cans.

The container comprises an elongated rectangular bottom wall 14, and elongated rectangular end walls 16 and 18 extending upwardly from opposite ends of the bottom wall at right angles thereto. Side walls 20 and 22 extend upwardly from opposite sides of the bottom wall at right angles thereto and ar marginally connected to the end walls. The side walls are spaced apart a distance slightly greater than the length of a beverage can and have cut-outs 23 to lighten the container and expose the contents to better view. The bottom and end walls may also have cut-outs, if desired.

The interior of the container is divided into a plurality of vertical chambers a-f by dividers in the form of strips 24 and 26. The divider strips 24 are connected to the inner surface of the side wall 20 in laterally spaced relation and extend vertically from the bottom wall to the top edge of the container. The divider strips 26 are connected to the inner surface of the wide wall 22 in the same laterally spaced relation as strips 24 and extend vertically from the bottom wall to the top edge of the container. These divider strips are disposed at right angles to the side wall to which they are attached. The divider strips are arranged in pairs with each pair consisting of a strip 24 on one side wall and a strip 26 on the other side wall such that they are in opposed or confronting relationship and lie in the same plane.

The chambers a-f defined by the pairs of divider strips are of a width slightly greater than the width of a can.

In accordance with this construction, a stack of cans 12 may be stored in each chamber in the manner illustrated. Since there are six chambers and each chamber holds four cans, a full case of twenty-four cans is accommodated. Obviously, however, the container may be altered dimensionally to carry more or fewer cans or cans of a different size without departing from the spirit of the invention.

A carrying strap 40 may be provided and is shown extending across the open top of the container to retain the contents and prevent them from accidentally falling out. One end of the strap has a releasable, snap-type connection 42 to the end wall 16. The opposite end of the strap may have a similar connection to end wall 18 or it may be permanently affixed thereto.

Bracing members 34 connect the divider strips of one or more of the pairs of divider strips to reinforce the container.

The container, including the bottom, side and end walls and the divider strips may be of one-piece construction of any suitable material. In the present instance, the container is molded from transparent plastic so that the contents are visible from the outside. The container may be loaded or unloaded through the open top when the strap is unsnapped. The strap not only holds the cans in the container, but provides a convenient means of carrying the container by hand.

Figure 4:
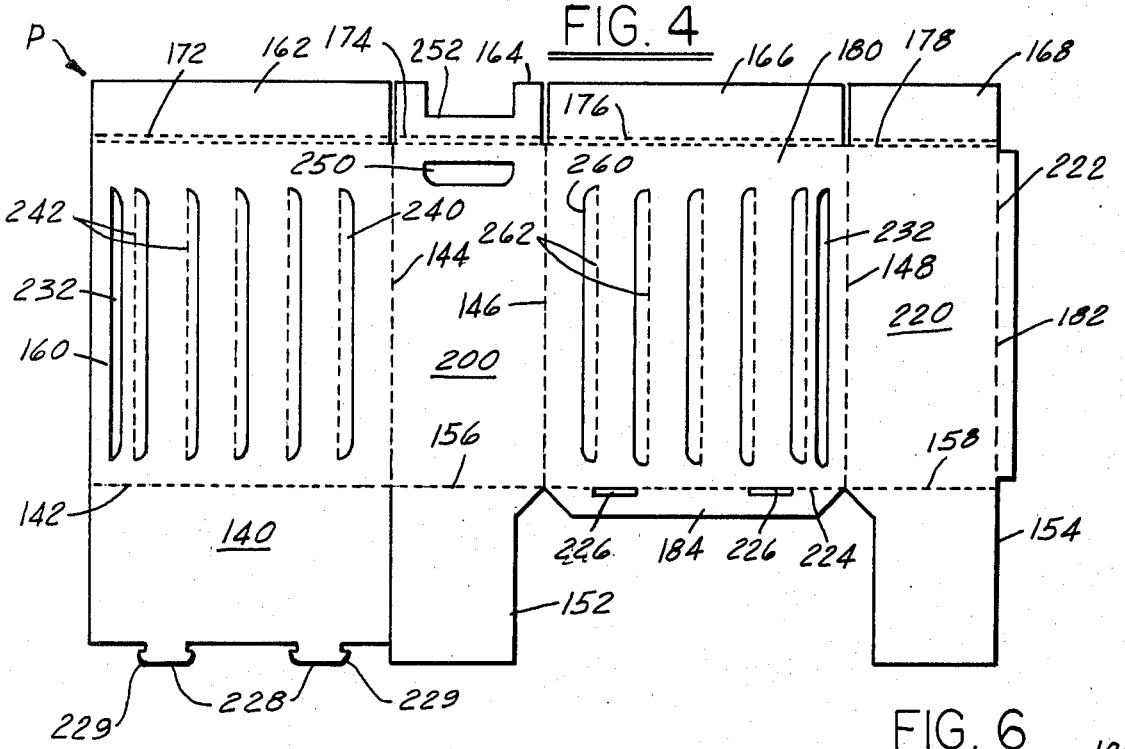
FIG. 4 is a layout of a panel from which a container of modified construction may be formed.
Figure 5:
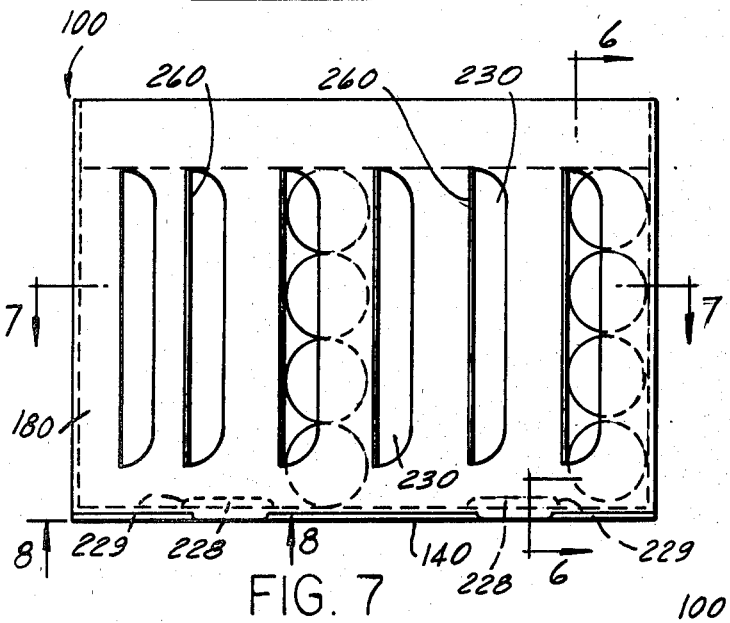
FIG. 5 is a side view of the modified container.

FIGS. 5-8 show a container 100 of modified construction and FIG. 4 shows a sheet or panel P from which the container 100 may be formed.

The container 100 is like container 10 in that it has an elongated rectangular bottom wall 140, and elongated rectangular side walls 160 and 180 extending upwardly from opposite sides of the bottom wall at right angles thereto. End walls 200 and 220 extend upwardly from opposite ends of the bottom wall at right angles thereto. The length, width and height of the container 100 is the same as container 10 so that a full case of cans may be carried therein.

The container 100 may be formed from a single flat sheet or panel P of cardboard or the like, shown in FIG. 4, and having lines or weakness provided by perforations to permit folding. The bottom wall 140 is connected to the side wall 160 by a line 142 of perforations. Lines 144, 146 and 148 of perforations connect the side and end walls 160, 180, 200 and 220 along their side edges. Flaps 152 and 154 are connected to the lower edges of the end walls 200 and 220 by lines 156 and 158 of perforations. Flaps 162, 164, 166 and 168 are connected to the upper edges of the side and end walls by lines 172, 174, 176 and 178 of perforations. A flap 182 is connected to a side edge of end wall 220 by a line 222 of perforations. A flap 184 is connected to the lower edge of side wall 180 by a line 224 of perforations. The flap 184 has holes 226 to receive tangs 228 along the free side edge of the bottom wall 140. These tangs have detents 229 to releasably lock in the holes.

The panel P is formed into a container by folding the side and end walls into rectangular shape along perforated lines 144, 146 and 148, with flap 182 folded inside the rectangle and secured as by adhesive to the side wall 160. Flaps 152, 154 and 184 are folded up along perforated lines 156, 158 and 224. These flaps are cut so that when folded their adjacent edges abut without overlapping. Bottom wall 140 is folded up along perforated line 142 and detents 228 inserted in the two holes 226 to retain the bottom wall in position. The flaps 162, 164, 166 and 168 are folded inward along perforated lines 172, 174, 176 and 178 is secured as by adhesive to the upper edge portions of the side and end walls.

The interior of the container is divided into a plurality of vertical chambers g-1 by divider strips 240 and 260. These divider strips are located in the same positions as strips 24 and 26 in the first embodiment, that is, they are disposed at substantially right angles to the side walls in pairs with a strip 240 and 260 of each pair in opposed confronting relationship. The strips 240 and 260 are flaps cut from the side walls and folded inward along vertical perforated lines 242 and 262 leaving openings 230 in the side walls to expose the contents of the container in five of the chambers h-1. The sixth chamber g is exposed by openings 232 in the side walls.

A hole 250 is formed in the end wall 200 to permit the container to be carried by hand. The flap 164 has a cut-out 252 to clear the hole 250.

Figure 6:
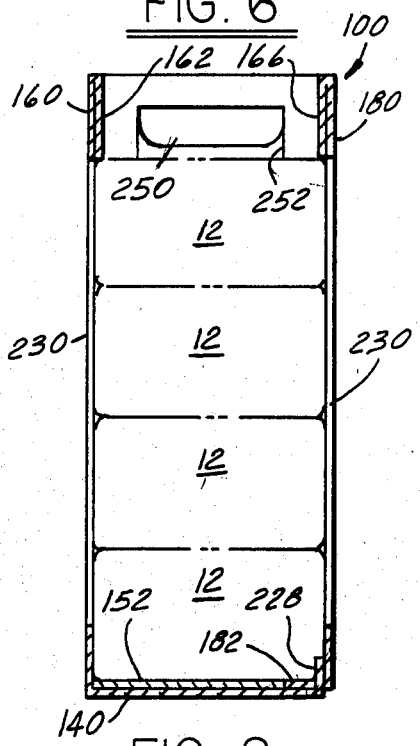
FIG. 6 is a sectional view taken on the line 6—6 in FIG. 5.
Figure 7:
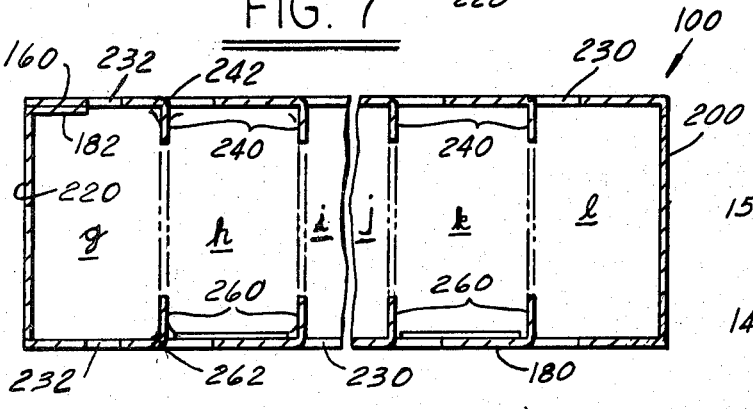
FIG. 7 is a sectional view taken on the line 7—7 in FIG. 5.
Figure 8:
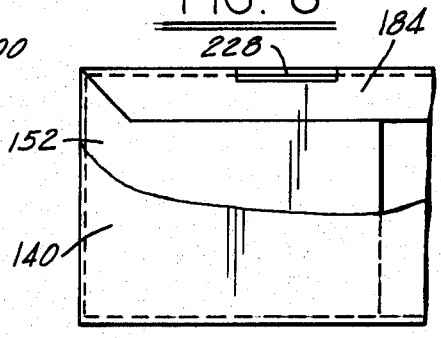
FIG. 8 is a view taken on the line 8—8 in FIG. 5.

As seen in FIG. 6, the length of the cans approximates the inside width of the container between side walls 160 and 180. The lower edges of the flaps 162 and 166 overlie the ends of the top can of the stacks of cans in the container to retain them against accidental dislodgment. The container is, of course, flexible enough to allow the cans to be inserted and removed past the flaps 162 and 166.

As in the embodiment first described, the container may be loaded and unloaded through the open top.

I claim:

1. An open top container for beverage cans and the like of predetermined length and diameter, said container being formed from a single sheet folded to provide an elongated bottom wall, end walls extending upwardly from opposite ends of said bottom wall at right angles thereto, side walls extending upwardly from opposite sides of said bottom wall at right angles thereto, said side walls being spaced apart a distance approximating the length of a beverage can, and a plurality of dividers extending vertically from a point adjacent said bottom wall to a point adjacent the top of said container, said dividers being spaced from one another and from said end walls a distance approximating the diameter of a beverage can to provide chambers each adapted to support a stack of beverage cans introduced through the open top of said container, each divider comprising a pair of flaps extending toward one another from the two side walls in opposed, laterally spaced relation, one flap of each pair being cut from one side wall and the other being cut from the other side wall, each flap extending continuously between said points adjacent said bottom wall and top of said container, said flaps being joined to said side walls by lines of weakness and folded inward at substantially right angles to said side walls leaving openings in the side walls to expose the contents of the container, whereby when a can is inserted into each chamber and rests upon the bottom wall of said container, said flaps will be retained in their inwardly folded positions by such inserted cans thereby facilitating the insertion of additional cans in stacked relation in each of said chambers.

* * * * *